US009353427B2

(12) United States Patent
Wang et al.

(10) Patent No.: US 9,353,427 B2
(45) **Date of Patent: *May 31, 2016**

(54) NI-BASED ALLOY, AND GAS TURBINE ROTOR BLADE AND STATOR BLADE EACH USING SAME

(75) Inventors: Yuting Wang, Hitachi (JP); Akira Yoshinari, Naka (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 421 days.

This patent is subject to a terminal disclaimer.

(21) Appl. No.: 13/579,642

(22) PCT Filed: Mar. 16, 2011

(86) PCT No.: PCT/JP2011/056212

§ 371 (c)(1),
(2), (4) Date: Aug. 17, 2012

(87) PCT Pub. No.: WO2011/122342

PCT Pub. Date: Oct. 6, 2011

(65) Prior Publication Data

US 2012/0308393 A1 Dec. 6, 2012

(30) Foreign Application Priority Data

Mar. 29, 2010 (JP) ..... 2010-075964

(51) Int. Cl.
*C22C 19/05* (2006.01)
*C22F 1/10* (2006.01)

(52) U.S. Cl.
CPC ..... *C22C 19/056* (2013.01); *C22F 1/10* (2013.01)

(58) Field of Classification Search
CPC ..... C22C 19/056; C22F 1/10
See application file for complete search history.

(56) References Cited

U.S. PATENT DOCUMENTS

| | | | | |
|---|---|---|---|---|
| 4,895,201 | A * | 1/1990 | DeCrescente et al. | 75/628 |
| 5,740,668 | A | 4/1998 | Fujiwara et al. | |
| 6,416,596 | B1 | 7/2002 | Wood et al. | |
| 6,546,713 | B1 | 4/2003 | Hidaka et al. | |

(Continued)

FOREIGN PATENT DOCUMENTS

| | | | | |
|---|---|---|---|---|
| GB | 2 105 748 | * | 3/1983 | C22C 19/05 |
| JP | 51-34819 | A | 3/1976 | |

(Continued)

OTHER PUBLICATIONS

English Abstract of Fujiwara, et al. (JP 07-286503), Oct. 31, 1995.*
English Abstract of Yoshinari (JP 2010-084166), Apr. 15, 2010.*

*Primary Examiner* — Jessee Roe
(74) *Attorney, Agent, or Firm* — Volpe and Koenig, P.C.

(57) ABSTRACT

This invention provides an Ni-based alloy, which is particularly used for standard casting and is provided with properties such as strength at high temperatures, corrosion resistivity, and oxidation resistivity in a more balanced manner, compared with existing materials. The Ni-based alloy comprises Cr, Co, Al, Ti, Ta, W, Mo, Nb, C, B, and unavoidable impurities, with the balance consisting of Ni. Composition of the alloy is represented by mass: 13.1% to 15.0% Cr, 1.0% to 15.0% Co, 2.3% to 3.3% Al, 4.55% to 6.0% Ti, 3.05% to 4.0% Ta, 4.35% to 4.9% W, 0.1% to 2.0% Mo, 0.05% to 0.5% Nb, less than 0.05% Zr, 0.05% to 0.2% C, and 0.01% to 0.03% B.

10 Claims, 5 Drawing Sheets

(56) References Cited

U.S. PATENT DOCUMENTS

| | | | | |
|---|---|---|---|---|
| 6,818,077 | B2 | 11/2004 | Yoshinari et al. | |
| 9,034,248 | B2 * | 5/2015 | Wang et al. | 420/448 |
| 2004/0011439 | A1 * | 1/2004 | Corrigan et al. | 148/555 |
| 2007/0253817 | A1 * | 11/2007 | Bezencon et al. | 416/97 R |
| 2010/0080730 | A1 | 4/2010 | Yoshinari | |

FOREIGN PATENT DOCUMENTS

| | | | |
|---|---|---|---|
| JP | 07-286503 | A | 10/1995 |
| JP | 2004-197131 | A | 7/2004 |
| JP | 2010-084166 | A | 4/2010 |
| WO | 99/31365 | A1 | 6/1999 |

* cited by examiner

NI-BASED ALLOY, AND GAS TURBINE ROTOR BLADE AND STATOR BLADE EACH USING SAME

TECHNICAL FIELD

The present invention relates to Ni-based alloys, which are provided with properties such as creep strength at high temperatures, oxidation resistivity, and corrosion resistivity in a well-balanced manner. More particularly, the present invention relates to Ni-based alloys used for gas turbine rotor blades, stator blades, and the like.

BACKGROUND ART

In recent years, internal combustion engines have been expected to work with improved thermal efficiency because of increasing environmental awareness regarding, for example, reduction of fossil fuel use, reduction of carbon dioxide emissions, and prevention of global warming. Heat engines such as gas turbines or jet engines are known to maximize thermal efficiency by operating with a high-temperature Carnot cycle at higher temperatures. As temperature rises at the turbine inlet, the importance of development and modification of materials used for gas turbine hot parts (i.e., combustors, turbine rotor blades, and stator blades) increases. In order to cope with such temperature elevation, Ni-based heat-resistant alloys exhibiting excellent high-temperature strength are employed as materials, and many Ni superalloys are employed at present. Ni-based alloys are classified as standard casting alloys comprising equiaxial crystals, unidirectionally solidified alloys comprising columnar crystals, and single-crystal alloys comprising a single crystal. In order to strengthen Ni-based alloys, it is necessary to add large quantities of solid-solution strengthening elements, such as W, Mo, Ta, and Co, and to allow large quantities of $\gamma'Ni_3$ (Al, Ti) phases (i.e., strengthening phases) to precipitate with the addition of Al and Ti.

Meanwhile, there is a tendency to use low-quality fuels containing large quantities of impurities causing corrosion as land-based gas turbine fuels due to elevated fuel prices. Accordingly, development of materials exerting high-temperature strength and corrosion resistivity is also necessary. Large quantities of Cr that form protective coating are preferably added in order to prepare such materials. Examples of alloys in which corrosion resistivity is regarded as important include standard casting alloys represented by Patent Document 1 or Patent Document 2.

As alloy element content increases, however, the tissue stability of materials deteriorates, and hard and fragile harmful phases (e.g., sigma phases) are disadvantageously precipitated after prolonged use.

In the past, specifically, it has been difficult to develop alloy materials excellent in creep strength at high temperatures, corrosion resistivity, and oxidation resistivity.

PRIOR ART DOCUMENTS

Patent Documents

Patent Document 1: JP Patent Publication (Kokai) No. 2004-197131 A

Patent Document 2: JP Patent Publication (Kokai) No. S51-34819 A (1976)

SUMMARY OF THE INVENTION

Object to be Attained by the Invention

An object of the present invention is to provide Ni-based alloys, which are provided with properties such as strength at high temperatures, corrosion resistivity, and oxidation resistivity in a well-balanced manner, compared with existing materials and, in particular, Ni-based alloys for standard casting.

Means for Attaining the Object

The present invention is summarized as follows.

(1) An Ni-based alloy comprising Cr, Co, Al, Ti, Ta, W, Mo, Nb, C, B, and unavoidable impurities, with the balance consisting of Ni, which is composed of 13.1% to 15.0% Cr, 1.0% to 15.0% Co, 2.3% to 3.3% Al, 4.55% to 6.0% Ti, 3.05% to 4.0% Ta, 4.35% to 4.9% W, 0.1% to 2.5% Mo, 0.05% to 0.5% Nb, less than 0.05% Zr, 0.05% to 0.2% C, and 0.01% to 0.03% B, by mass.

(2) The Ni-based alloy according to (1), which is composed of 13.1% to 15.0% Cr, 1.0% to 7.9% Co, 2.3% to 3.3% Al, 4.55% to 6.0% Ti, 3.05% to 4.0% Ta, 4.35% to 4.9% W, 0.1% to 0.9% Mo, 0.05% to 0.5% Nb, less than 0.05% Zr, 0.05% to 0.2% C, and 0.01% to 0.03% B.

(3) The Ni-based alloy according to (1), which is composed of 13.1% to 15.0% Cr, 10.1% to 15.0% Co, 2.3% to 3.3% Al, 4.55% to 6.0% Ti, 3.05% to 4.0% Ta, 4.35% to 4.9% W, 1.05% to 2.0% Mo, 0.05% to 0.5% Nb, less than 0.05% Zr, 0.05% to 0.2% C, and 0.01% to 0.02% B.

(4) The Ni-based alloy according to (1), which is composed of 13.6% to 14.1% Cr, 2.0% to 6.9% Co, 2.6% to 3.3% Al, 4.55% to 5.5% Ti, 3.05% to 3.4% Ta, 4.55% to 4.9% W, 0.6% to 0.9% Mo, 0.05% to 0.25% Nb, less than 0.05% Zr, 0.10% to 0.18% C, and 0.01% to 0.02% B.

(5) The Ni-based alloy according to (1), which is composed of 13.8% to 14.1% Cr, 5.0% to 6.9% Co, 3.0% to 3.3% Al, 4.7% to 5.1% Ti, 3.1% to 3.4% Ta, 4.55% to 4.85% W, 0.7% to 0.9% Mo, 0.15% to 0.25% Nb, less than 0.05% Zr, 0.12% to 0.16% C, and 0.01 to 0.03% B.

(6) The Ni-based alloy according to (1), which is composed of 13.3% to 14.3% Cr, 10.1% to 12.0% Co, 2.9% to 3.3% Al, 4.65% to 5.5% Ti, 3.05% to 4.0% Ta, 4.55% to 4.9% W, 1.1% to 1.6% Mo, 0.15% to 0.25% Nb, less than 0.05% Zr, 0.10% to 0.18% C, and 0.01% to 0.02% B.

(7) The Ni-based alloy according to (1), which is composed of 13.5% to 14.1% Cr, 10.1% to 11.0% Co, 3.0% to 3.3% Al, 4.7% to 5.1% Ti, 3.1% to 3.4% Ta, 4.55% to 4.85% W, 1.2% to 1.5% Mo, 0.15% to 0.25% Nb, less than 0.05% Zr, 0.12% to 0.16% C, and 0.01% to 0.02% B.

(8) The Ni-based alloy according to any of (1) to (7), which further comprises 0.01% to 0.05% Hf.

(9) A cast product comprising the Ni-based alloy according to any of (1) to (8).

(10) A gas turbine rotor blade comprising the Ni-based alloy according to any of (1) to (8).

(11) A gas turbine stator blade comprising the Ni-based alloy according to any of (1) to (8).

(12) A gas turbine comprising the gas turbine rotor blade according to (10) and/or the gas turbine stator blade according to (11).

This description includes part or all of the content as disclosed in the description and/or drawings of Japanese Patent Application No. 2010-075964, which is a priority document of the present application.

Effects of the Invention

The present invention provides Ni-based alloys, which are provided with properties such as strength at high temperatures, corrosion resistivity, oxidation resistivity, and other properties in a well-balanced manner, compared with existing materials. Such alloys are particularly optimal for standard casting. Further, the Ni-based alloys of the present invention comprise C and B, which are effective for strengthening the crystal grain boundary, and Hf, which is effective for inhibiting cracking at the crystal grain boundary at the time of casting. Thus, such alloys have compositions that are suitable for unidirectionally solidified alloy materials.

EMBODIMENTS FOR CARRYING OUT THE INVENTION

Figure 4:
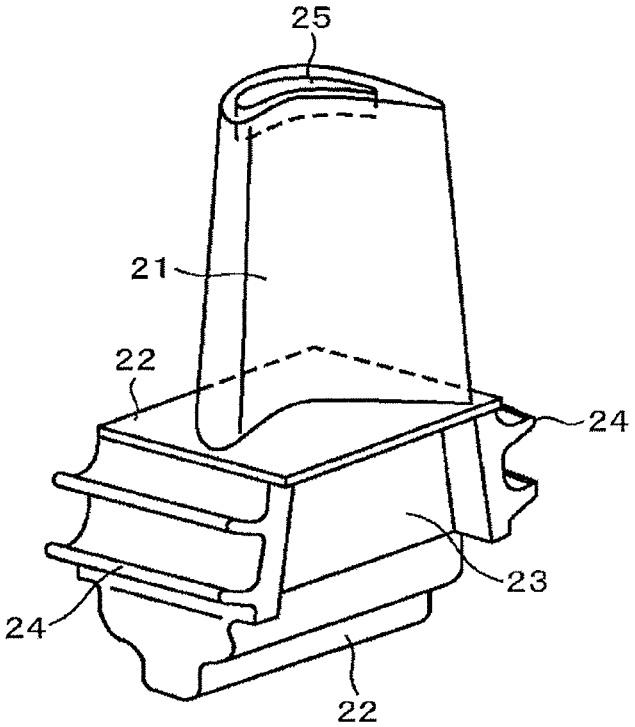
FIG. 4 shows an embodiment of a rotor blade configuration of the gas turbine.

FIG. 4 shows an embodiment of a configuration of a rotor blade of a land-based gas turbine for power generation. A gas turbine rotor blade is a rotational part having a complicated cooling structure inside itself. It is exposed to severe environments under which the centrifugal force during rotation and thermal stress upon start-stop are repeatedly applied. A rotor blade is required to have excellent basic properties in terms of creep strength at high temperatures, oxidation resistivity in high-temperature combustion gas atmospheres, and corrosion resistivity. Accordingly, it is important to develop an alloy composition for casting that is provided with the properties described above in a well-balanced manner without sacrificing any such properties at significant levels.

In general, standard casting, unidirectionally solidified casting, and single-crystal casting techniques are known as techniques for manufacturing gas turbine blades. Unidirectionally solidified alloys and single-crystal alloys are mainly used for rotor and stator blades of small, lightweight jet engines (aviation gas turbines). However, the process for casting blades with the use of unidirectionally solidified alloys or single-crystal alloys is complicated, and the yield when casting blades is poor. Since land-based gas turbine blades are large in size and complicated in configuration, in particular, the casting yield is very poor, and the resulting products disadvantageously become very expensive.

Accordingly, the present inventors adjusted the amounts of elements added to alloys and examined alloys that are particularly optimal for standard casting and are provided with properties such as strength at high temperatures, corrosion resistivity, and oxidation resistivity in a well-balanced manner, compared with existing materials. Hereafter, functions of components of the Ni-based alloys according to the present invention and preferable compositional ranges are described.

Cr: 13.1% to 15.0% by Mass

Cr is an element that is effective for improving corrosion resistivity of alloys at high temperatures. In order to improve resistivity to molten salt corrosion, in particular, greater effects can be attained as Cr content is increased. Such effects become more apparent when the content exceeds 13.1% by mass. Since large quantities of Ti, W, Ta, and the like are added to the alloys of the present invention, excessive increase of the amount of Cr results in precipitation of fragile TCP phases, and strength at high temperatures then deteriorates. It is accordingly preferable that the upper limit thereof be 15.0% by mass from the viewpoint of a balance with other alloy elements. Thus, high strength and high corrosion resistivity can be attained. It is preferably 13.3% by mass or more, more preferably 13.5% by mass or more, further preferably 13.6% by mass or more, particularly preferably 13.8% by mass or more, 14.3% by mass or less, and particularly preferably 14.1% by mass or less.

Co: 1.0% to 15.0% by Mass

Co lowers the solid-solution temperature of the γ' phase (the NiAl intermetallic compound, $Ni_3Al$) to facilitate solution treatment. In addition, Co strengthens the γ' phase by the solid-solution mechanism and improves high-temperature corrosion resistivity. Further, Co reduces the stacking-fault energy to improve ductility at room temperature. Such effects appear at Co content of 1.0% by mass or more.

As Co content increases, the solid-solution temperature of the γ' phase gradually decreases. Accordingly, the amount of the γ' phase precipitated decreases, and creep strength deteriorates. Thus, Co content needs to be 15.0% by mass or less.

When creep strength and ductility at room temperature in the mesophilic temperature range significantly influenced by the solid-solution strengthening by Co are considered to be important, accordingly, Co content is preferably 10.1% to 15.0% by mass, more preferably 10.1% to 12.0% by mass, and further preferably 10.1% to 11.0% by mass within the compositional range according to the present invention.

When creep strength at high temperatures resulting from strengthened precipitation of the γ' phase is considered to be more important than creep strength in the mesophilic temperature range, it is preferable to reduce the Co content. Such content is preferably 1.0% to 7.9% by mass, more preferably 2.0% to 6.9% by mass, and further preferably 5.0% to 6.9% by mass.

W: 4.35% to 4.9% by Mass

W is integrated into the matrix γ phase and in the precipitation γ' phase in the solid state and it can enhance the creep strength via solid-solution strengthening. It is necessary for W content to be 4.35% by mass or more in order to sufficiently attain the effects as described above. Because of its high specific gravity, however, W increases the alloy density and causes deterioration of the corrosion resistivity of alloys at high temperatures. In the case of alloys comprising large quantities of Ti and Cr, such as the alloys of the present invention, acicular α-W is precipitated when W content exceeds 4.9% by mass, and creep strength, corrosion resistivity at high temperatures, and toughness deteriorate. Accordingly, it is preferable that the upper limit thereof be 4.9% by mass. When the balance of strength at high temperatures, corrosion resistivity, and tissue stability at high temperatures is taken into consideration, such content is preferably 4.55% to 4.9% by mass, and more preferably 4.55% to 4.85% by mass.

Ta: 3.05% to 4.0% by Mass

Ta is integrated into the γ' phase in the form of $[Ni_3(Al,Ta)]$ in the solid state and it has the effect of improving creep strength via solid-solution strengthening. In order to attain such effect sufficiently, Ta content of 3.05% by mass or more is necessary. When the content exceeds 4.0% by mass, however, the mixture is over-saturated, the acicular 6 phase [Ni, Ta] is precipitated, and creep strength is deteriorated. Thus, the upper limit needs to be 4.0% by mass. When the balance between strength at high temperatures and tissue stability is taken into consideration, in particular, it is preferably 3.05% to 3.5% by mass, and more preferably 3.1% to 3.4% by mass.

Mo: 0.1% to 2.5% by Mass

Mo has the effects similar to those of W. Accordingly, Mo can be partially substituted with W, according to need. In order to elevate the solid-solution temperature of the γ' phase, Mo has the effect of improving creep strength, as does W. Mo content needs to be 0.1% by mass or more in order to attain such effect, and creep strength is improved as Mo content is increased. In addition, the specific gravity of Mo is lower than that of W, and the alloy weight can thus be reduced.

However, Mo causes deterioration of oxidation resistivity and corrosion resistivity of alloys. As Mo content increases, in particular, oxidation resistivity significantly deteriorates. It is thus necessary for the upper limit of the Mo content to be 2.5% by mass, and preferably 2.0% by mass. When priority is placed on creep strength while maintaining substantially the same level of oxidation resistivity at high temperatures with existing alloys, Mo content is preferably 1.05% to 2.5% by mass, more preferably 1.1% to 2.0% by mass, further preferably 1.1% to 1.6% by mass, and particularly preferably 1.2% to 1.5% by mass. When priority is placed on corrosion resistivity or oxidation resistivity at high temperatures while maintaining substantially the same level of creep strength as those of existing alloys, Mo content is preferably 0.1% to 0.9% by mass, more preferably 0.6% to 0.9% by mass, and further preferably 0.7% to 0.9% by mass.

Ti: 4.55% to 6.0% by Mass

While Ti is integrated into the γ' phase in the form of [$Ni_3$(Al,Ta,Ti)] in the solid state as in the case of Ta, the effects thereof for solid-solution strengthening are not as satisfactory as those of Ta. Rather, Ti significantly improves corrosion resistivity of alloys at high temperatures. Ti content of 4.55% by mass or more is necessary in order to attain significant effects in resistivity to molten salt corrosion. When Ti is added in an amount exceeding 6.0% by mass, however, oxidation resistivity significantly deteriorates, and the fragile phase is precipitated. Accordingly, it is necessary that the upper limit be 6.0% by mass. When the balance among strength at high temperatures, corrosion resistivity, and oxidation resistivity of alloys containing 13.1% to 15.0% Cr by mass as with the alloys of the present invention is taken into consideration, Ti content is preferably 4.55% to 5.5% by mass, more preferably 4.65% to 5.5% by mass, and particularly preferably 4.7% to 5.1% by mass.

Al: 2.3% to 3.3% by Mass

Al is a main constitutive element of the γ' phase [$Ni_3Al$], which is a precipitation-strengthened phase, and it improves creep strength. In addition, Al significantly contributes to improvement in oxidation resistivity at high temperatures. In order to attain such effects sufficiently, Al content of 2.3% by mass or more is necessary. Since Cr, Ti, and Ta contents are high in the alloys of the present invention, the γ' phase [$Ni_3$(Al,Ta,Ti)] is excessively precipitated when Al content exceeds 3.3% by mass. This disadvantageously causes deterioration of strength, results in the formation of composite oxide with chromium, and causes deterioration of corrosion resistivity. Accordingly, Al content is preferably from 2.3% to 3.3% by mass. When the balance among strength at high temperatures, oxidation resistivity, and corrosion resistivity is taken into consideration within such compositional range, Al content is preferably 2.6% to 3.3% by mass, more preferably 2.9% to 3.3% by mass, and particularly preferably 3.0% to 3.3% by mass.

Nb: 0.05% to 0.5% by Mass

While Nb is integrated into the γ' phase in the form of [$Ni_3$(Al,Nb,Ti)] in the solid state as in the case of Ti, the effects thereof for solid-solution strengthening are greater than those of Ti. Also, Nb has the effect of improving corrosion resistivity at high temperatures, although such effect is not as significant as that of Ti. In order to attain the effect of solid-solution strengthening at high temperatures with the addition of Nb, the content thereof needs to be 0.05% by mass or more. In the case of alloys comprising large quantities of Ti, such as the alloys of the present invention, however, Nb content exceeding 0.5% by mass results in precipitation of the fragile η phase, and strength deteriorates significantly. Thus, the upper limit of Nb content is preferably 0.5% by mass. When the balance among strength at high temperatures, corrosion resistivity, and oxidation resistivity is taken into consideration, in particular, Nb content is preferably 0.05% to 0.25% by mass, and more preferably 0.15% to 0.25% by mass.

C: 0.05% to 0.2% by Mass

C is segregated at the crystal grain boundary, it improves crystal grain boundary strength, part thereof forms carbides (e.g., TiC and TaC), and the resultants are precipitated in clumps. In order to increase the grain boundary strength by segregating C at the crystal grain boundary, it is necessary to add C in an amount of 0.05% by mass or more. If C is added in an amount exceeding 0.2% by mass, however, excess carbides are generated, creep strength at high temperatures and ductility deteriorate, and corrosion resistivity also deteriorates. Thus, the upper limit should be 0.2% by mass. When the balance among strength, ductility, and corrosion resistivity is taken into consideration within such compositional range, C content is preferably from 0.10% to 0.18% by mass, and more preferably from 0.12% to 0.16% by mass.

B: 0.01% to 0.03% by Mass

B is segregated at the crystal grain boundary, it improves crystal grain boundary strength, part thereof forms boride ($(Cr,Ni,Ti,Mo)_3B_2$), and the resultants are precipitated at the alloy grain boundaries. In order to increase the grain boundary strength by segregating B at the crystal grain boundary, it is necessary to add B in an amount of 0.01% by mass or more. Since the melting temperature of boride is lower than that of an alloy, the addition of excess amounts thereof significantly lowers the alloy melting temperature, and it makes solution treatment difficult. Thus, the upper limit is preferably 0.03% by mass. When the balance between strength and solution-thermal treatment processes is taken into consideration within such compositional range, it is preferably 0.01% to 0.02% by mass.

Zr: Less than 0.05% by Mass

Zr is segregated at the crystal grain boundary and it improves the crystal grain boundary strength to some extent. However, most Zr forms an intermetallic compound with nickel at the crystal grain boundary (i.e., $Ni_3Zr$). Such intermetallic compound causes deterioration of alloy ductility and has a low melting temperature. Accordingly, it lowers the alloy melting temperature and narrows the temperature range for solution treatment. That is, the effectiveness of Zr is low. Accordingly, Zr content may be 0, and the upper limit thereof is 0.05% by weight.

Hf: 0.01% to 0.05% by Mass

Hf is effective for inhibiting cracks at the crystal grain boundary at the time of casting. Accordingly, addition thereof to the alloys of the present invention is preferable. The amount thereof added is preferably 0.01% to 0.05% by mass.

Re: 0.5% by mass or less

Re can be partially substituted with W, according to need. Re is an effective element in that it is integrated into the matrix γ phase in the solid state, it enhances the creep strength via solid-solution strengthening, and it improves corrosion resistivity of alloys. However, Re is expensive, it has a high specific gravity, and it increases an alloy specific gravity. Alloys comprising 13.1% to 15.0% Cr by mass facilitate precipitation of acicular α-W or α-Re (Mo) and cause deterioration of creep strength and toughness when Re content exceeds 0.5% by mass. Accordingly, the upper limit thereof should be 0.5% by mass. Re content is preferably 0.1% by mass or less in the alloys of the present invention, and it is more preferable that substantially no Re be added.

O: Less than 0.005% by Mass; N: Less than 0.005% by Mass; S: Less than 0.005% by Mass; and P: Less than 0.005% by Mass Oxygen and nitrogen are unavoidable impurities. These elements are often introduced into alloys from alloy starting materials, O is introduced from a crucible, and masses of oxides ($Al_2O_3$) and nitrides (TiN or MN) are present in alloys. If such substances are present in cast products, they initiate cracking during creep deformation. In addition, such substances cause deterioration of creep fracture life and fatigue life by causing fatigue cracks. In particular, oxygen appears on a cast surface in the form of an oxide, it creates surface defects on cast products, and it lowers the yields of cast products. Accordingly, lower contents of such elements is more preferable. When ingots are actually prepared, however, oxygen inclusion cannot be avoided. Thus, oxygen and nitrogen contents are each preferably less than 0.005% by mass, so that such elements would not significantly cause deterioration of alloy properties. In addition, sulfur and phosphorus are unavoidable impurities, and these elements are introduced into alloys from alloy starting materials. As a result of eutectic reactions of S, P, and Ni, low-melting substances (e.g., Ni—P and Ni—S) form films at the crystal grain boundary, cracking is likely to occur at high temperatures, and the creep fracture life of blades deteriorates easily. Accordingly, P and S contents are each preferably less than 0.005% by mass, so that such elements would not significantly cause deterioration of alloy properties in terms of anti-cracking properties at high temperatures.

The term "unavoidable impurities" used herein refers to substances that are present in alloy starting materials or inevitably introduced into alloys during the process of alloy production. Such substances are not necessary under normal conditions, the amounts thereof are very small, and such substances would not influence the properties of the alloys of the present invention.

Ni-based alloys comprising the components described above and unavoidable impurities, with the balance consisting of Ni, are provided with properties such as strength at high temperatures, oxidation resistivity, and corrosion resistivity in a well-balanced manner, and such alloys are preferably used for cast products such as gas turbine rotor blades and stator blades.

An embodiment of a gas turbine rotor blade comprising the Ni-based alloys above is described with reference to FIG. 4, although constitutions thereof are not limited to those described below. FIG. 4 is a perspective view showing the entire constitution of the gas turbine rotor blade. The gas turbine rotor blade is used in hot gas at 1,300° C. or higher while the inside thereof is cooled with air. For example, it is used in the form of a rotor blade at the first part of the gas turbine rotating part equipped with three separate rotor blades. As shown in FIG. 4, the gas turbine rotor blade comprises a blade 21, a platform 22, a shank 23, a seal fin 24, and a chip pocket 25, and it is mounted on a disc via dovetailing. For example, the length of the gas turbine rotor blade is 100 mm, the blade length extending downwardly from the platform 22 is 120 mm, and the gas turbine rotor blade is provided with cooling holes (not shown) through the blade 21 from the dovetail, so that the cooling medium, and, in particular, air or water vapor, can pass therethrough. Thus, the gas turbine rotor blade can be cooled internally. The blade 21 and the platform 22 of the gas turbine rotor blade exposed to combustion gas may be provided with thermal barrier coatings.

The Ni-based alloys of the present invention are provided with properties such as creep fracture strength, oxidation resistivity, and corrosion resistivity in a well-balanced manner, and the practical utility thereof is superior to that of existing alloys. Accordingly, the Ni-based alloys of the present invention are preferably used for the gas turbine rotor blades as described above, and such alloys can also be used for the gas turbine stator blades.

Figure 5:
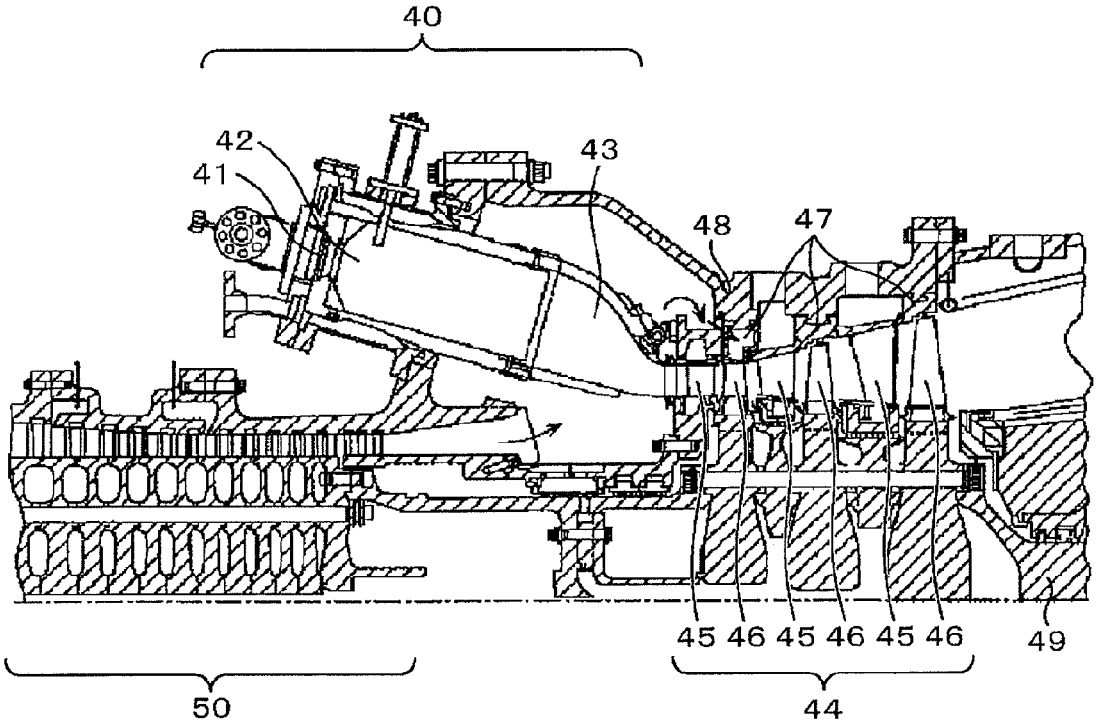
FIG. 5 schematically shows a cross section of the gas turbine.

Subsequently, an embodiment of the gas turbine equipped with rotor and stator blades comprising the Ni-based alloys of the present invention is described with reference to FIG. 5. FIG. 5 schematically shows a cross section of a principle part of the gas turbine for power generation. The gas turbine comprises a turbine casing 48, a rotor (rotating axis) 49 at the center inside the casing 48, a gas turbine rotor blade 46 provided at the periphery of the rotor 49, a gas turbine stator blade 45 supported by the casing 48, and a turbine 44 having a turbine shroud 47. Also, the gas turbine comprises a compressor 50 conjugated to the turbine 44 that imports air to attain compressed air for combustion and cooling media and a combustor 40. The combustor 40 comprises a combustor nozzle 41 that mixes compressed air supplied from the compressor 50 with a supplied fuel (not shown) and sprays the mixed air. The mixed air is subjected to combustion in the combustor liner 42 to generate high-temperature and high-pressure combustion gas, and the combustion gas is supplied to the turbine 44 through the transition piece (tail covert) 43. Thus, the rotor 49 rotates at high speed. Some of the compressed air ejected from the compressor 50 is used as the air for cooling the insides of the combustor liner 42, the transition piece 43, the gas turbine stator blade 45, the gas turbine rotor blade 46, and the like of the combustor 40. The high-temperature and high-pressure combustion gas generated in the combustor 40 is rectified with the gas turbine stator blade 45 through the transition piece 43, and the rectified gas is sprayed onto the gas turbine rotor blade 46 to rotate and drive the turbine 44. In general, power is generated by a power generator bound to the end of the rotor 49 (the generator is not shown).

A significant feature of the gas turbine is that it can be operated appropriately with a wide variety of fuels ranging from gas fuels to liquid fuels. For example, LNG or off-gas can be employed as a gas fuel. Alloys excellent in oxidation resistivity are suitable for a gas turbine involving the use of LNG. In the case of a gas turbine involving the use of off-gases with large quantities of impurities, however, alloys are required to be excellent in terms of both oxidation resistivity and corrosion resistivity. Liquid fuels can be light fuel oils, heavy fuel oils, and the like, and such fuels contain corrosive components, such as S and Na. Thus, a gas turbine involving the use of such liquid fuels is required to be excellent in terms of oxidation resistivity and corrosion resistivity. Since location, operating conditions, fuels to be used, and other conditions vary for each gas turbine, materials of gas turbine rotor and stator blades are required to be excellent in terms of creep strength, corrosion resistivity, and oxidation resistivity, in order to cope with such various conditions.

The Ni-based alloys of the present invention are excellent in creep strength, corrosion resistivity, and oxidation resistivity. Accordingly, such alloys are preferable as materials for gas turbine rotor and stator blades that are operated appropriately with a wide variety of fuels ranging from gas fuels to liquid fuels as described above.

EXAMPLES

Hereafter, the present invention is described in greater detail with reference to examples and comparative examples, although the present invention is not limited thereto.

Table 1 shows the compositions (% by mass) of Ni-based alloys subjected to testing. In Table 1, Test pieces A1 to A6 are examples of the present invention and Test pieces B1 to B3 are existing alloys (comparative examples). Test pieces were prepared by melting master ingots and weighed alloy elements in alumina crucibles and casting the resultants into flat plates each with a thickness of 14 mm. The casting temperature was 1,373 K, the pour point was 1,713 K, and an alumina ceramic cast was used. After casting, the test pieces were subjected to solution heat-treatment and aging heat-treatment under the conditions shown in Table 2. Test pieces A1 to A6 were first subjected to solution heat-treatment at 1,480 K for 2 hours in order to homogenize the alloy compositions. After the solution heat-treatment, the test pieces A1 to A6 were air-cooled and then subjected to aging heat-treatments under the conditions of 1,366 K/4 hours/air-cooling, 1,325 K/4 hours/air-cooling and 1,116 K/16 hours/air-cooling. Thereafter, the test pieces were processed and subjected to the creep fracture test, the corrosion test, and the oxidation test in the manner described below.

Specifically, a creep test piece (diameter of parallel parts: 6.0 mm; length thereof: 30 mm), a high-temperature oxidation test piece (length: 25 mm; width: 10 mm; thickness: 1.5 mm), and a conformational high-temperature corrosion test piece (15 mm×15 mm×15 mm) were cut from the heat-treated test pieces via mechanical processing, microtissues were observed under a scanning electron microscope (Hitachi 3200), and the tissue stability of the alloys was evaluated.

Figure 1:
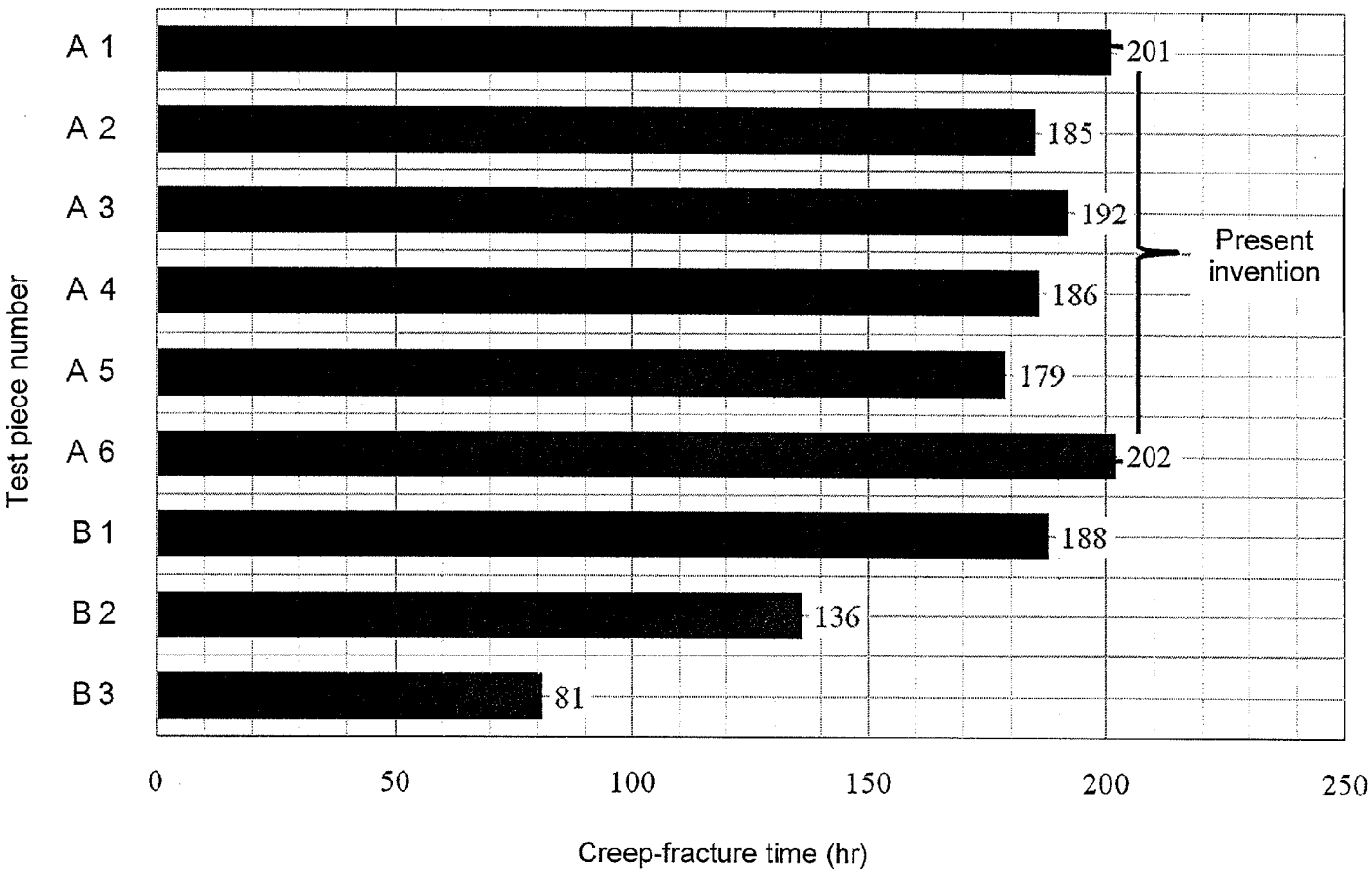
FIG. 1 is a chart showing the creep-fracture time of the alloy test pieces.
Figure 2:
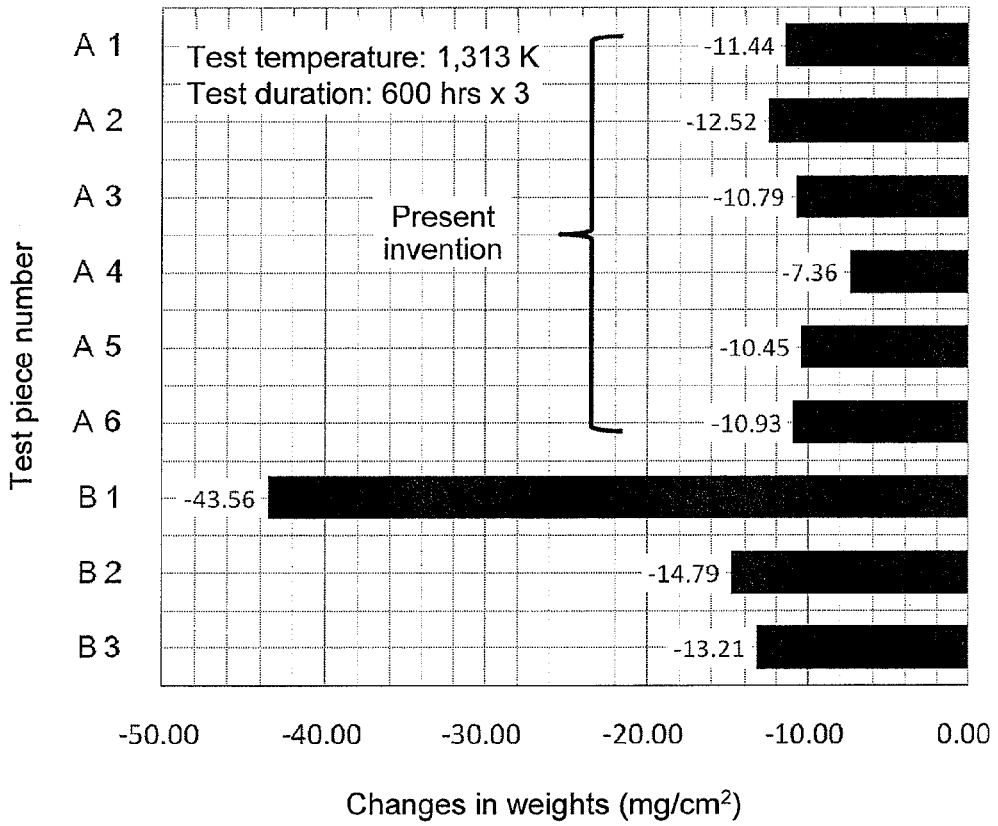
FIG. 2 is a chart showing the amount of oxidation reduced determined by the high temperature oxidation test of the alloy test pieces.
Figure 3:
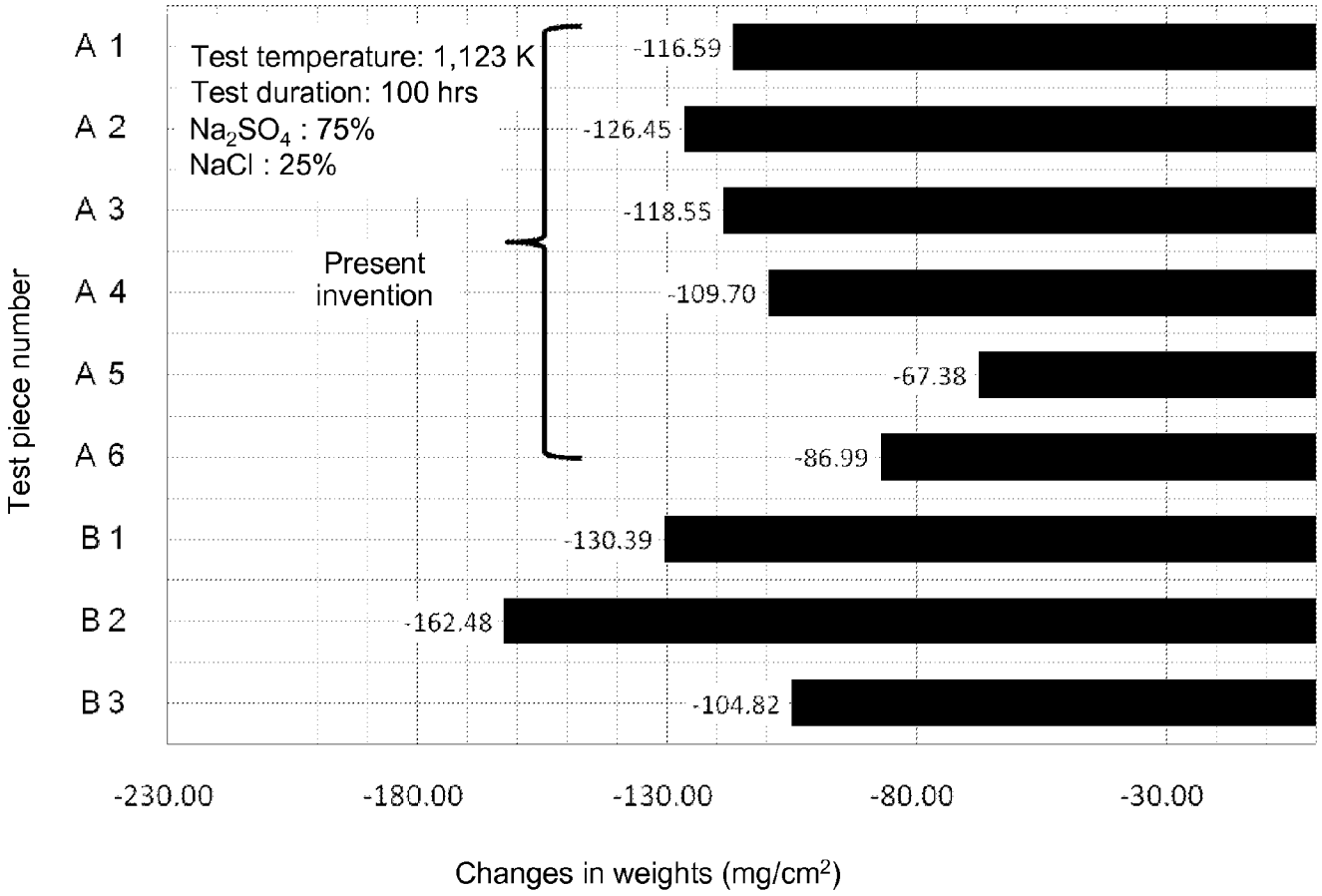
FIG. 3 is a chart showing the amount of corrosion reduced determined by the corrosion test via soaking of the alloy test pieces in molten salt.

Table 3 shows test conditions for property evaluations performed on test pieces. The creep-fracture test was carried out at 1,255 K and 138 MPa. The high-temperature oxidation test was carried out by repeating oxidation tests at 1,313 K for 600 hours three times and measuring changes in weights. The high-temperature corrosion test was carried out by repeating tests comprising soaking test pieces in molten salt (75% $Na_2SO_4$ and 25% NaCl) at 1,123 K for 25 hours four times (100 hours in total) and measuring changes in weights. Test results are shown in Table 4 and FIGS. 1 to 3. Table 4 shows a list of test results. FIG. 1 shows a bar chart representing the creep-fracture time at 1,255 K and 138 MPa, FIG. 2 shows a bar chart representing the amount of oxidation reduced determined via high-temperature oxidation testing, and FIG. 3 shows a bar chart representing the amount of corrosion reduced determined via corrosion testing via soaking in molten salt.

TABLE 1

Table 1: Compositions of Ni-based alloys

| | Test piece No. | Cr | Co | Ti | Al | Mo | W | Ta | Nb | Hf | Re | P | Zr | S | C | B | O | N | Ni |
|---|---|---|---|---|---|---|---|---|---|---|---|---|---|---|---|---|---|---|---|
| Examples | A1 | 13.71 | 10.15 | 4.81 | 3.01 | 1.25 | 4.46 | 3.02 | 0.21 | 0.04 | 0.005 | 0.002 | 0.01 | 0.003 | 0.14 | 0.015 | 0.001 | 0.002 | 58.145 |
| | A2 | 13.85 | 10.32 | 4.66 | 2.96 | 1.34 | 4.58 | 3.25 | 0.15 | 0.01 | 0.004 | 0.003 | 0.02 | 0.001 | 0.14 | 0.015 | 0.001 | 0.003 | 58.37 |
| | A3 | 13.91 | 10.54 | 4.58 | 3.24 | 1.41 | 4.86 | 3.13 | 0.12 | 0.03 | 0.009 | 0.003 | 0.01 | 0.005 | 0.12 | 0.015 | 0.002 | 0.002 | 57.92 |
| | A4 | 14.12 | 6.45 | 5.02 | 2.95 | 0.86 | 4.64 | 3.27 | 0.20 | 0.02 | 0.006 | 0.004 | 0.02 | 0.001 | 0.10 | 0.015 | 0.001 | 0.001 | 62.785 |
| | A5 | 14.15 | 6.53 | 4.76 | 3.21 | 0.68 | 4.78 | 3.12 | 0.17 | 0.03 | 0.004 | 0.001 | 0.02 | 0.004 | 0.10 | 0.015 | 0.003 | 0.001 | 62.585 |
| | A6 | 13.94 | 6.72 | 4.55 | 3.25 | 0.81 | 4.86 | 3.23 | 0.16 | 0.01 | 0.009 | 0.003 | 0.03 | 0.003 | 0.12 | 0.015 | 0.001 | 0.002 | 62.215 |
| Existing alloys (Comp. Ex.) | B1 | 14.03 | 9.56 | 4.85 | 3.01 | 4.15 | 4.12 | 0 | 0 | 0 | 0.005 | 0.004 | 0.04 | 0.002 | 0.17 | 0.015 | 0.001 | 0.003 | 60.36 |
| | B2 | 14.12 | 9.42 | 4.92 | 3.12 | 1.65 | 3.69 | 2.82 | 0 | 0.09 | 0.008 | 0.004 | 0.02 | 0.003 | 0.09 | 0.012 | 0.002 | 0.001 | 60.07 |
| | B3 | 15.91 | 8.32 | 4.78 | 3.35 | 1.75 | 2.67 | 1.75 | 0.85 | 0.02 | 0.006 | 0.003 | 0.01 | 0.005 | 0.11 | 0.01 | 0.002 | 0.002 | 59.985 |

TABLE 2

Conditions for solution heat treatment and aging heat treatment

| Test piece | | | Aging conditions | | |
|---|---|---|---|---|---|
| Type | No. | Solution conditions | First aging | Second aging | Third aging |
| Examples | A1 to A6 | 1480 K/2 h AC | 1366 K/4 h AC | 1325 K/4 h AC | 1116 K/16 h AC |
| Existing alloys (Comp. Ex.) | B1 | 1480 K/2 h AC | 1366 K/4 h AC | — | — |
| | B2 | 1395 K/2 h | 1116 K/K | — | — |
| | B3 | 1480 K/2 h AC | 1366 K/4 h AC | 1325 K/4 h AC | 1116 K/16 h AC |

TABLE 3

| Conditions for property evaluation tests | |
|---|---|
| Evaluation tests | Test contents |
| Creep-fracture test | Test temperature and stress<br>1,255 K and 138 MPa |
| Oxidation test | Repeated oxidation tests<br>1,313 K for 600 hours × 3 |
| Corrosion test | Soaking test in molten salt 1,123 K<br>$NaSO_4$ (75%) + NaCl (25%) |

TABLE 4

| Results of property evaluation tests | | | | |
|---|---|---|---|---|
| Item | Test piece No. | Creep-fracture test 1255 K-138 MPa (h) | Changes in weights (amount of oxidation reduced) ($mg/cm^2$) | Changes in weights (amount of corrosion reduced) ($mg/cm^2$) |
| Invention | A1 | 201 | −11.44 | −116.59 |
| | A2 | 185 | −12.52 | −126.45 |
| | A3 | 192 | −10.79 | −118.55 |
| | A4 | 186 | −7.36 | −109.70 |
| | A5 | 179 | −10.45 | −67.38 |
| | A6 | 202 | −10.93 | −86.99 |
| Existing alloys (Comp. Ex.) | B1 | 188 | −43.56 | −130.39 |
| | B2 | 136 | −14.79 | −162.48 |
| | B3 | 81 | −13.21 | −104.82 |

As is apparent from the results shown in Table 4, the alloys A1 to A6 of the present invention would require substantially the same duration for creep fracture as the existing alloy B1 (equivalent to Rene 80), such alloys would undergo substantially the same degree of change in weight due to corrosion, and such alloys would undergo significant reduction in the degree of change in weight due to oxidation. That is, the oxidation resistivity thereof is improved. In comparison with another existing alloy, B2 (equivalent to GTD 111), oxidation resistivity and corrosion resistivity were at substantially the same levels, and the creep-fracture time was increased to 1.5 times or higher than that of alloy B2. In comparison with another existing alloy B3 (equivalent to IN 738 LC), oxidation resistivity and corrosion resistivity were at substantially the same levels, and the creep-fracture time was increased to twice or higher that of the alloy B3.

Specifically, corrosion resistivity at high temperatures and oxidation resistivity can be significantly improved without sacrificing creep fracture life at high temperatures according to the present invention. That is, an alloy provided with properties such as creep strength, oxidation resistivity, and corrosion resistivity in a well-balanced manner can be obtained.

In the examples above, effects of standard casting materials were described. Since the alloys of the present invention comprise C and B, which are effective for strengthening the crystal grain boundary, and Hf, which is effective for inhibiting cracking at the crystal grain boundary at the time of casting, such alloys have compositions suitable for use as unidirectionally solidified materials.

As described above, nickel-based superalloys that are excellent in creep strength at high temperatures, corrosion resistivity, and oxidation resistivity and that can be subjected to standard casting can be obtained according to the present invention. Such alloys are particularly preferably used for forming rotor blades and stator blades of a land-based gas turbine.

All publications, patents, and patent applications cited herein are incorporated herein by reference in their entirety.

DESCRIPTION OF NUMERAL REFERENCES

21: Blade
22: Platform
23: Shank
24: Seal fin
25: Chip pocket
40: Combustor
41: Combustor nozzle
42: Combustor liner
43: Transition piece
44: Turbine
45: Gas turbine stator blade
46: Gas turbine rotor blade
47: Turbine shroud
48: Turbine casing
49: Rotor
50: Compressor

The invention claimed is:

1. A standard cast Ni-based alloy consisting essentially of Cr, Co, Al, Ti, Ta, W, Mo, Nb, C, B, and the balance being Ni and unavoidable impurities, wherein content of the Ni-based alloy is 13.1% to 15.0% Cr, 10.1% to 15.0% Co, 2.3% to 3.3% Al, 4.55% to 6.0% Ti, 3.05% to 4.0% Ta, 4.35% to 4.9% W, 1.05% to 2.0% Mo, 0.05% to 0.5% Nb, less than 0.05% Zr, 0.05% to 0.2% C, and 0.015% to 0.02% B, by mass.

2. The standard cast Ni-based alloy according to claim 1, which is composed of 13.3% to 14.3% Cr, 10.1% to 12.0% Co, 2.9% to 3.3% Al, 4.65% to 5.5% Ti, 3.05% to 4.0% Ta, 4.55% to 4.9% W, 1.1% to 1.6% Mo, 0.15% to 0.25% Nb, less than 0.05% Zr, 0.10% to 0.18% C, and 0.015% to 0.02% B.

3. The standard cast Ni-based alloy according to claim 1, which is composed of 13.5% to 14.1% Cr, 10.1% to 11.0% Co, 3.0% to 3.3% Al, 4.7% to 5.1% Ti, 3.1% to 3.4% Ta, 4.55% to 4.85% W, 1.2% to 1.5% Mo, 0.15% to 0.25% Nb, less than 0.05% Zr, 0.12% to 0.16% C, and 0.015% to 0.02% B.

4. The standard cast Ni-based alloy according to claim 1, which further comprises 0.01% to 0.05% Hf.

5. A cast product comprising the standard cast Ni-based alloy according to claim 1.

6. A gas turbine rotor blade comprising the standard cast Ni-based alloy according to claim 1.

7. A gas turbine stator blade comprising the standard cast Ni-based alloy according to claim 1.

8. A gas turbine comprising the gas turbine rotor blade according to claim 6.

9. A gas turbine comprising the gas turbine stator blade according to claim 7.

10. A gas turbine comprising a gas turbine rotor blade comprising the standard cast Ni-based alloy according to claim 1 and a gas turbine stator blade comprising the standard cast Ni-based alloy according to claim 1.

* * * * *